United States Patent [19]

Delbarre

[11] Patent Number: 4,542,796

[45] Date of Patent: Sep. 24, 1985

[54] PROCESS AND DEVICE FOR DRILLING THE SOIL

[75] Inventor: Jean Delbarre, Beuvry, France

[73] Assignee: Electricite de France, Paris, France

[21] Appl. No.: 496,850

[22] Filed: May 23, 1983

[30] Foreign Application Priority Data

May 27, 1982 [FR] France ..... 82 09701

[51] Int. Cl.[4] ..... E21B 11/02

[52] U.S. Cl. ..... 175/19; 175/22; 175/62

[58] Field of Search ..... 175/162, 19, 53, 62, 175/94, 22; 173/152

[56] References Cited

U.S. PATENT DOCUMENTS

| | | | |
|---|---|---|---|
| 1,179,491 | 4/1916 | Ammon | 175/19 |
| 3,113,628 | 12/1963 | Orcutt | 175/152 |
| 3,845,828 | 11/1974 | Taylor | 175/73 |
| 4,024,721 | 5/1977 | Takada | 61/72.7 |

FOREIGN PATENT DOCUMENTS

| | | | |
|---|---|---|---|
| 2333339 | 3/1975 | Fed. Rep. of Germany | 102 D/760 |
| 1359841 | 3/1963 | France | 175/62 |
| 309954 | 4/1969 | Sweden | 175/22 |

*Primary Examiner*—Stephen J. Novosad

*Assistant Examiner*—Michael A. Goodwin

*Attorney, Agent, or Firm*—Ladas & Parry

[57] ABSTRACT

The invention concerns itself with a process and a device for drilling the soil, more particularly but not exclusively, for the purpose of laying pipelines.

A guide block (26) that slides on means that form a slide bar (27, 28) parallel with the direction of drilling (43) in relation to a skelton (29) under the action of pressing means (37, 38) acting between the skeleton (29) and the guide block (46) internally delimits a housing (46) at least partly closed towards the rear and laterally and open towards the front in reference to the direction of drilling (43) for receiving means that form a tube (20) having a rectilinear axis (44) and an end zone (19) projecting towards the front and supporting a detachable tool (6) consisting of a boring bit (6) having externally, successively from the front to the rear, a flat cutting edge (52) across the axis (44) of the tube (20), a frustoconical cutting edge (16) converging towards the front with reference to the direction of drilling (43) and a cylindrical cutting edge (17) that joins said frustoconical cutting edge.

It is applied to the mechanical industry and to public works.

7 Claims, 7 Drawing Figures

PROCESS AND DEVICE FOR DRILLING THE SOIL

Figure 1:
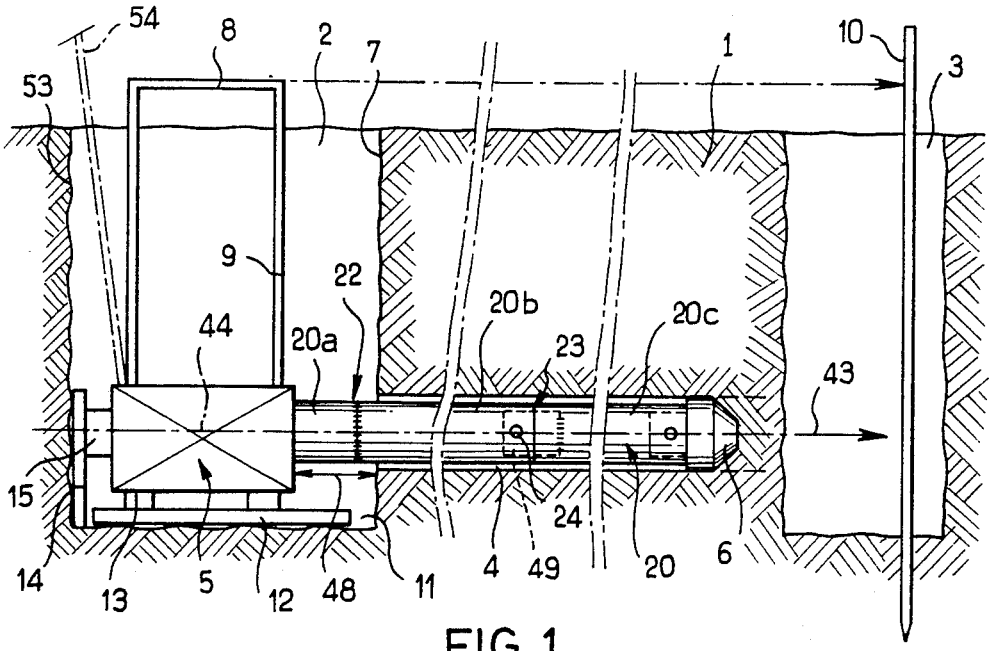

The invention concerns itself with a process and a device for drilling the soil, more particularly but not exclusively for the purpose of laying pipelines.

It has hitherto been generally necessary to open a ditch for ensuring the laying of rigid or supple pipelines, laying of ducts for conveying gas, protective sheaths for electric and telephonic cables, or pipes for the supply and drainage of the waters of buildings or those of a subterranean system for sprinkling or irrigating a tilled field.

This opening of ditches in the surface of a road or the lawn of a park evidently destroys up to its surface the structure of the ground, a structure that must then be restored at great expense.

In addition, said opening hinders the normal use of the surface, since it makes it necessary to remove a very considerable volume of earth that must subsequently be returned for filling up the ditch.

In order to overcome said inconveniences, several devices known already have been used for drilling a simple hole in the ground to make it possible then longitudinally to slide the pipeline therein.

For example, in the case of a pipeline to be passed underneath a highway, the hole is drilled starting from a pit in which the device is introduced to a depth according to that of the drilling for which the device comprises a tool which, starting from said pit, will progressively work until reaching a pit of arrival.

Therefore, instead of a whole ditch it is sufficient to dig the pits at both ends, which can even be preexisting pits such as caves.

One of the implements hitherto known comprises (French Pat. No. A-2,372,309) a nozzle fed by fluid under pressure that is ejected in the form of a jet in charge of disintegrating the soil.

However, said device has a limited application, since it is not suited to hard soil and, for instance, to a highway perforation where the implement is likely to find, together with earth, stones and other obstacles.

Another implement known already has a conical general shape and comprises (French Pat. Nos. A-2,330,748 and 2,416,307) a motor that drives in rotation eccentrics that progressively make the hole by compacting the soil until obtaining the hole of a diameter equal to that of the base of the cone of the tool.

The same as in the devices known already, the orientation of the tool is not determined by the device but by the hole on the wall of which the tool is situated; specially in the case of non-homogeneous soils that cause variable lateral restraints, this work by eccentrics often gives rise to deviations of the tool.

These deviations make more than uncertain the arrival point of the tool and, despite the passing of the tool can hinder the passage of the pipeline that is much longer.

Another implement known already (French Pat. Nos. A-2,399,305, 2,336,519, 2,240,321, 2,198,507 and 2,161,732) consists in a point or striking nose associated with a tubular body provided with a percussion means actuated by a pneumatic circuit.

Even though the strokes are parallel with the axis of the tool, the advance by strokes and the slight rebound obtained likewise have the inconvenience, when the tip of the tool reaches a zone of great resistance, of favoring the deviation of said tool.

With the devices known already, in addition to the problem of orientation, it is to be generally deplored that the device for threading the pipelines into the hole drilled by the tool also requires the creation of a very considerable pit, which for short drillings practically makes said device of no interest in comparison with the ditches.

A result that the invention intends to obtain is a process and device for drilling the soil that will ensure great precision and because of this make possible drillings between two very distant points.

Another result intended by the invention is a device for which pits of small dimensions are sufficient.

To this effect, the object of the invention is a soil-drilling device that includes a supporting frame, a tool, displacement means of the tool for translation in relation iwth the frame in a certain direction of drilling, and means for supporting the frame on the soil at least towards the rear with reference to said direction, characterized:

in that the displacement means of the tool for translation in relation to the frame in the drilling direction include:

(a) means forming a slide that are integral with the frame and oriented parallel with the drilling direction, (b) a guide block supported by said slide-forming means and guided for translation therealong parallel with the drilling direction in relation to the frame, said guide block internally defining a housing at least partly closed towards the rear and laterally and open towards the front in reference to the drilling direction, (c) pressure means acting between the frame and the guide block in the direction of translation of the latter along the slide-forming means in relation to the frame at least in the drilling direction, (d) means that form a tube having a rectilinear axis, the tube being fitted in the housing and in abutment in the interior of the latter, in relation to the guiding block, toward the rear and laterally in reference to the drilling direction, in a position in which the axis of the tube is parallel with said direction, but being free for translation within said housing in opposite direction in relation to the guiding block, and the dimension of the tube parallel with the axis thereof being larger than the dimension of the housing parallel with the drilling direction even if the tube has an end zone projecting forwardly, in reference to the drilling direction, outside the housing of the guide block, and in that the tool comprises (e) a boring bit integrally carried by said end zone of the tube and externally having, successively from the front to the rear in reference to the drilling direction, a flat cutting edge across the axis of the tube, a frustoconical cutting edge revolving about the axis and converging to the front in reference to the drilling direction, a cylindrical cutting edge revolving about the axis of the tube and joining said frustoconical cutting edge, said cylindrical cutting edge having a diameter larger than the dimensions that the tube externally has transversely in relation to its axis and a dimension, measured parallel with said axis, that is insignificant in relation to the corresponding dimension of the tube, (f) a stem integral with the boring bit immediately behind said cylindrical cutting edge of the latter in reference to the drilling direction, said stem being inserted in said end zone of the tube, detachable locking means ensuring the integration of said stem with the tube.

An object of the invention is also a drilling process to form a pit by means of said device, characterized in that:

(a) the frame of the device is set in respect to the ground in a manner such that the axis of the tube-forming means correspond exactly with an axis of the hole to be drilled, the guide block occupying a rear end position taking into consideration the direction of the drilling, and the boring bit is mounted in the end zone before the tube, (b) with the aid of the pressure means that regularly press the guide block and of the tube that regularly relays said pressure in the drilling direction, the boring bit is forced into the ground for drilling a hole therein, (c) with the aid of the pressure means, the guide block that slides on the tube is drawn back in a direction opposite to the drilling direction, (d) in the housing of the guide block is disposed a portion of tube of which the front is joined to the rear of said tube for extending the tube-forming means, and the guide block and tube-forming means, carrying the boring bit, are pressed in the drilling direction with the aid of the pressure means for continuing the hole, (e) steps c and d are repeated until the boring bit reaches said pit where the boring bit is dismounted from the tube-forming means.

In case the drilled hole must be provided with a metal lining, the tube-forming means are left in place for directly making said lining.

In case the drilled hole is not to be provided with a metal lining, after having secured on the tube, at the site of the boring bit, a pipeline or cable that is going to be disposed within the tube, the frame being set in relation to the soil towards the front in reference to the drilling direction, (a) there are locked together the tube-forming means and the guide block that occupies a foremost position taking into consideration the drilling direction, then (b) the pressure means are actuated for drawing the guide block and the tube-forming means in a direction opposite to the drilling direction, and, when the guide block arrives at a rearmost position in reference to the drilling direction and a portion of the tube is released from the drilled hole, (c) said portion is separated from the tube-forming means and is released from the guide block, and steps a, b and c are started again until the tube-forming means are wholly outside the drilled hole.

Figure 3:
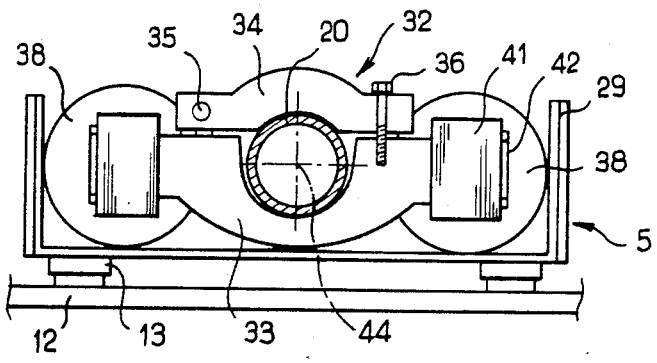
Figure 4:
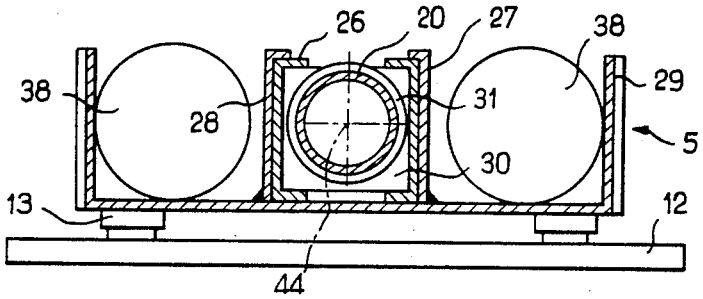

The invention will be well understood with the help of the description that follows, given as non-limiting example, with relation to the attached drawing, which diagrammatically shows:

FIG. 1: the device according to the invention in an intermediate phase of a drilling operation, from pit to pit, in horizontal direction, in a vertical section passing through the axis of the tube-forming means, FIG. 2: the device seen from below and ready for drilling, FIG. 3: a section according to III—III of FIG. 2, FIG. 4: a section according to IV—IV of FIG. 2, FIG. 5: a view analogous to that of FIG. 1 illustrating the final phase of the drilling, FIG. 6: a view analogous to that of FIG. 1 illustrating a possibility of directly making a lining within the drilled hole, FIG. 7: a view analogous to that of FIG. 1 illustrating the positioning of a flexible pipeline in the drilled hole.

Referring to FIG. 1, it is seen that in this mode of operation of the invention, in the soil 1 are provided two pits 2, 3, of which one (2) is the beginning of the hole 4 to be drilled and the other (3) is the end of said hole.

In the starting pit 2 there is lowered the device 5 equipped with a drilling tool (6) intended to erode the soil to the desired depth, starting from a surface 7 of the starting pit 2, called front surface, which is certainly the one disposed at the side of the end pit in a drilling direction 43 that is here horizontal and will serve of reference to the expressions "front" and "rear" used hereinafter; the device 5 ready to drill can be seen in FIGS. 2 to 4.

Prior to this erosion, the direction and inclination of the path of the tool are controlled by a sighting system 8, which, by the vertical enlargements 9 situated on a frame 29 of the device 5, is carried below the level of the soil to a preferably regulatable height, said sighting system cooperating with a vertical pole 10 situated in the end pit 3.

To ensure a good base for the device 5, the starting pit 2 has its bottom 11, which can be more or less closed and is provided with a platform or at least with crossbeams 12 duly adjusted.

The frame 29 of the device 5 rests on this support, preferably by means of screw jacks 13 that make it possible to correct the inclination of the device, that is, of the drilling direction 43.

Likewise, in order that the rear surface 53 of the pit 2 can serve as support towards the rear of the frame 29 of the device, it is provided with a crossbeam 14 on which said device rests by means of screw jacks 15 that make it possible to rectify its orientation, that is, the orientation of the drilling direction 43.

The tool 6 is a boring bit having externally, successively from the front to the rear, a flat cutting edge 52 across an axis 44 stationary in respect to the frame 29 and defining the drilling direction 43, a frustoconical cutting edge 16 that revolves about the axis 44 and converges toward the front, a cylindrical cutting edge 17 that revolves about the axis 44 having a diameter D that corresponds to that of the hole 4 to be drilled and identical with that of the large base of the cone frustrum that defines the surface 16, and said boring bit integrally carries, immediately behind the cylindrical cutting edge 17, a cylindrical centering stem 18 that revolves about the axis 44 and enters in a foremost zone 19 of a rectilinear tube 20 externally defined by a cylindrical cutting edge that revolves about the axis 44 with a diameter d lesser than D and a length L measured parallel with the axis 44 in relation to which the corresponding dimension $\lambda$ of the surface 7 is negligible: the stem 18 of the boring bit 6 is integrally but detachably secured inside the foremost zone 19 of the tube 20 by any adequate dismountable means 21 such as a bolt or a pin.

The tube 20, which at the start of a drilling operation can be a single portion 20*a*, is then, taking into consideration the limited length of the pit, necessarily formed of several portions (with the reference numerals 20*a*, 20*b*, 20*c*, at the end of drilling in the non-limiting example shown this number can be different), which in order to form a rigid and rectilinear whole of axis 44 are connected to each other, for instance, by stitches or a welding filament (such as illustrated in 22, for example between portions 20*b* and 20*c*) or by a dismountable means (such as illustrated in 23) such as a sleeve (such as 49) welded in one of the portions (such as 20*a*) and held detachably in the other portion (such as 20*b*) by a pin (such as 24); in general the same manner of coupling can be used for all the portions, different manners having been shown exclusively by way of illustration.

By a rearmost zone 25, a portion 1 of the length L of the tube 20 is inserted in the housing 46 of a guide block 26 guided in translation parallel with the axis 44 by slides 27, 28 integral with the frame 29 and parallel with said axis.

The housing 46 is closed towards the rear and laterally in respect to the axis 44 but open to the front so as to receive the tube 20 sliding in relation to the guide block 26 following the axis 44 and constituting an abutment for the tube toward the rear and laterally without on the other hand opposing the forward sliding of the tube in relation to the guide block 26.

In a rearmost zone the guide block 26 carries to this effect in an integral manner a thrust-plate 30 for the rear end 25 of the tube 20, said plate closing the housing 46 toward the rear across the axis 44.

On this thrust-plate there is integrally mounted toward the front a ring 31 of axis 44, which, directly or by means of a reducing connection, centers the rear end 25 of the tube 20 in respect to the axis 44.

In addition, in a foremost zone, the guide block 26 carries a collar 32 closed around an intermediate zone 47 of the tube 20, and which, directly or by means of a cushion, centers said tube 20 in respect to the axis 44.

The collar 32 comprises a sector 33 that is integral with the guide block 26 and a sector 34 that can be dismounted in order to open the collar 32 to free for the tube 20 the access between the interior and the exterior of said collar, laterally in respect to the drilling direction 43, that is, to allow the entrance and exit of the tube 20 in and from the housing 46 at the top of the device if reference is had to the position illustrated in FIG. 1. This dismountable sector 34 is, for example, at one of its ends, linked about an axis 35 carried by the stationary sector 33 and parallel with the axis 44, while at its other end said dismountable sector 34 is detachably secured to the stationary sector 33 by a screw 36.

Having been centered opposite to the axis 44 by the collar 32 toward the front and by the ring 31 toward the rear, the tube 20 is perfectly guided in the guide block 26 itself perfectly guided by the slides 27, 28 in respect to the frame 29; the inclined and oriented adjustment of the frame 29 by acting upon the supporting screw-jacks 13 and 15 also ensures to the tube 20 the benefit of the same adjustments.

With the stationary sector 33 of the collar 32 is also integrally associated a yoke 37 for pressing the guide block 26 and therefore the tube 20, there actuating upon said yoke pressure means such as two screw-jacks 38 situated each on one side of the guide block 26 and of the tube 20, parallel with the axis 44 the cylinder 39 of which is integral with the frame 29 of the device behind the yoke 37 while the rod 40 of the piston (not shown) terminates by a means 41 such as a cap that grasps the yoke 37 of the collar, which, to this effect, carries, for instance, two spindles 42.

The hydraulic cylinders 38 are preferably hydraulic and of double action and fluid under pressure is supplied to them by means of a distributor and of conduits 54 connected to a unit not shown, perferably separated from the device in order to be left on the surface and for allowing the use of a unit having other uses such as that of the shovel that dug the pit.

In the case where the rear face 53 of the pit would run the risk of not withstanding the pressure of the hydraulic cylinders 38, it is quite evident that a rear thrust-plate (not shown) carried by the stem of said shovel could serve as support for the device.

Figure 2:
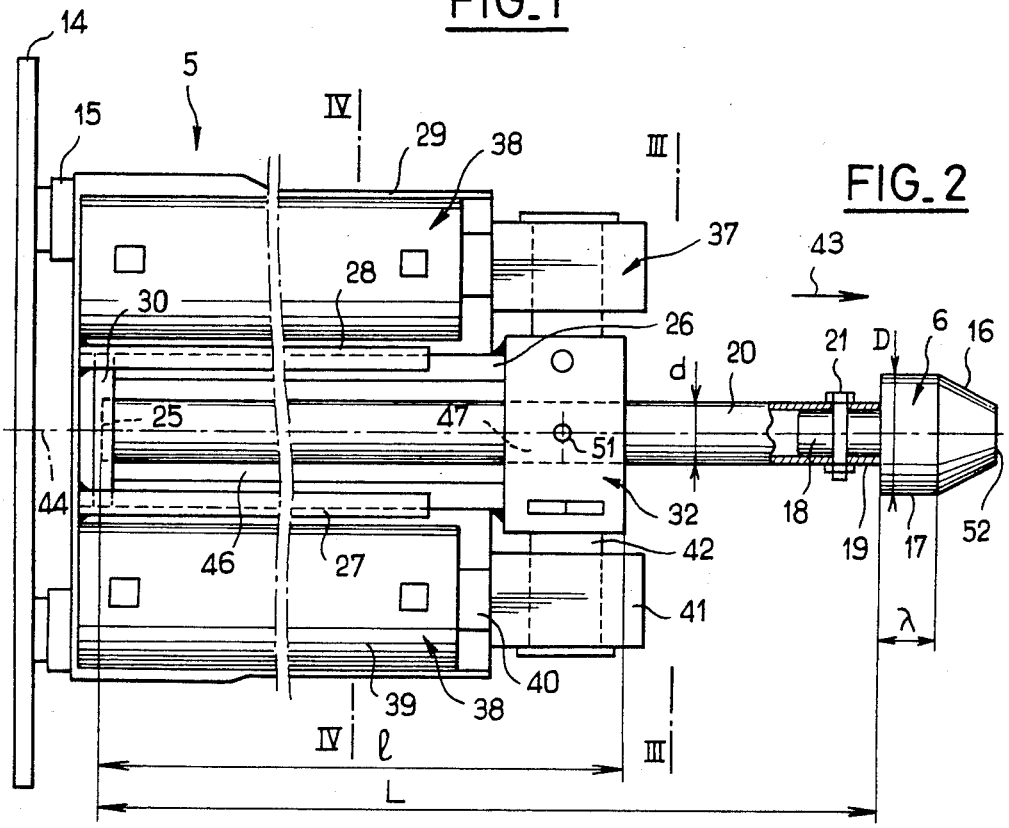
Figure 5:
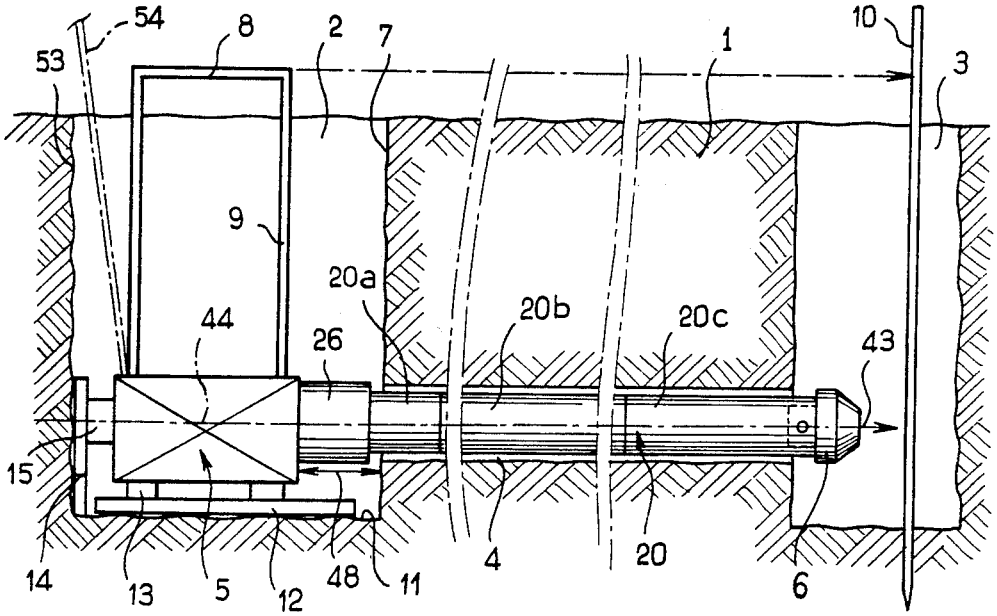

With the device object of the invention, the drilling process is the following:

adjusting the frame 20 by the bottom and by the rear in respect to the soil 1 by virtue of the screw-jacks 15 and 13, the device is positioned in a manner such that the axis 44 of the portion 20*a* of the tube 20 that it initially carries correspond exactly to the axis of the hole 4 to be drilled; the hydraulic cylinders 38 are first retracted, the guide block 26 and the tube 20 occupying in respect to the frame 29 a rearmost position illustrated in FIG. 2;

the boring bit 6 is mounted in the foremost zone 19 of the tube 20, the hydraulic cylinders 38 are actuated in the direction 43 and by means of said hydraulic cylinders thus regularly pressing to the front the guide block 26 and by means of the tube 20 relaying to the boring bit 6 said regular pressure, the boring bit 6 is forced into the soil 1 in the axis of the hole 4 to be drilled, that is, in the drilling direction 43 defined by the axis 44 until the guide block 26 reaches a foremost position (seen in FIG. 5) in relation to the frame 9 along the slides 27, 28;

by means of the hydraulic cylinders 38 that are actuated in opposite direction the guide block 26 is then brought back in a direction opposite to the direction 43, but since the guide block 26 is not secured to the tube 20 that it alone centers, it returns by itself to the rearmost position leaving the portion 20*a* of the tube and the boring bit 6 in the drilled hole 4;

opening the collar 37, there is then situated in the rear guiding ring 31 a portion 20*b* of the tube 20 the front of which is then set up behind the preceding tube portion 20*a*, the collar 37 is then closed on said portion 20*b* and by means of the screw-jacks 38 the whole formed by the guide block 26, the portions 20*a* and 20*b* and the boring bit 6 is pressed in the direction 43;

these last two steps are repeated until the boring bit 6 reaches the pit 3 where the boring bit is dismounted from the tube portion 20*a;* this arrival, illustrated in FIG. 5, needs in the illustrated example the coupling of a supplementary tube portion 20*c* behind the portion 20*b*, a different number of portions naturally not departing from the scope of this invention; FIG. 1 illustrates an intermediate phase of drilling, the portion 20*c* having been coupled with the portion 20*b*, but the guide block 26 occupying still its rearmost position.

Figure 6:
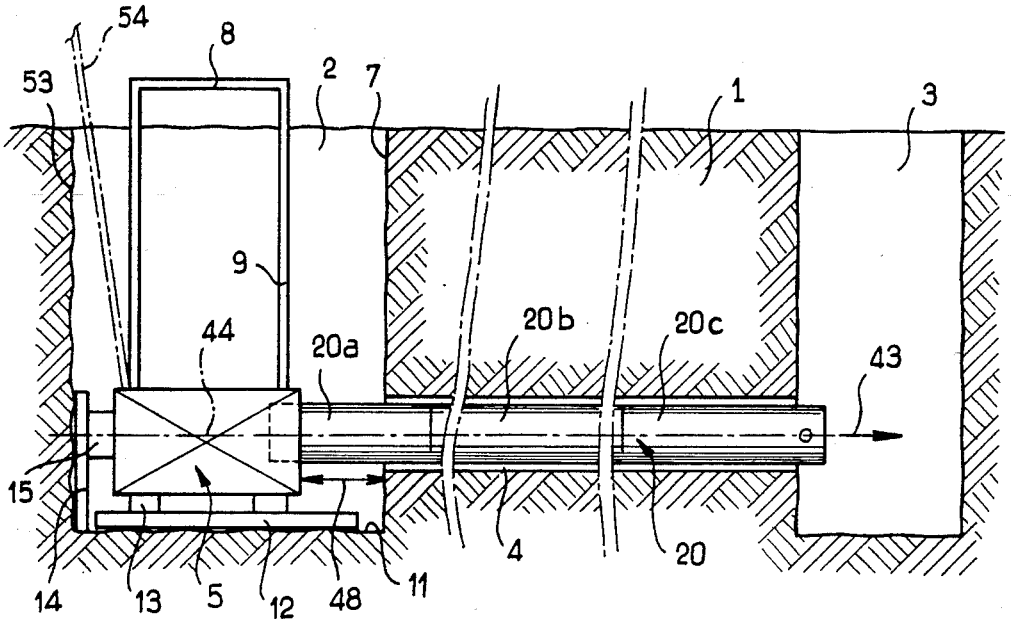

Having reached this stage, in case the drilled hole 4 must be provided with a metal lining, the tube 20 can be left in use for directly producing said lining, as shown in FIG. 6: the boring bit 6 is dismounted from the tube 20 and the guide block 26 is returned to the rear, then the collar 37 is opened if necessary for withdrawing therefrom the rear portion 20*c*.

In this case the coupling between the portions of the tube 20 is preferably obtained by welding end to end.

Figure 7:
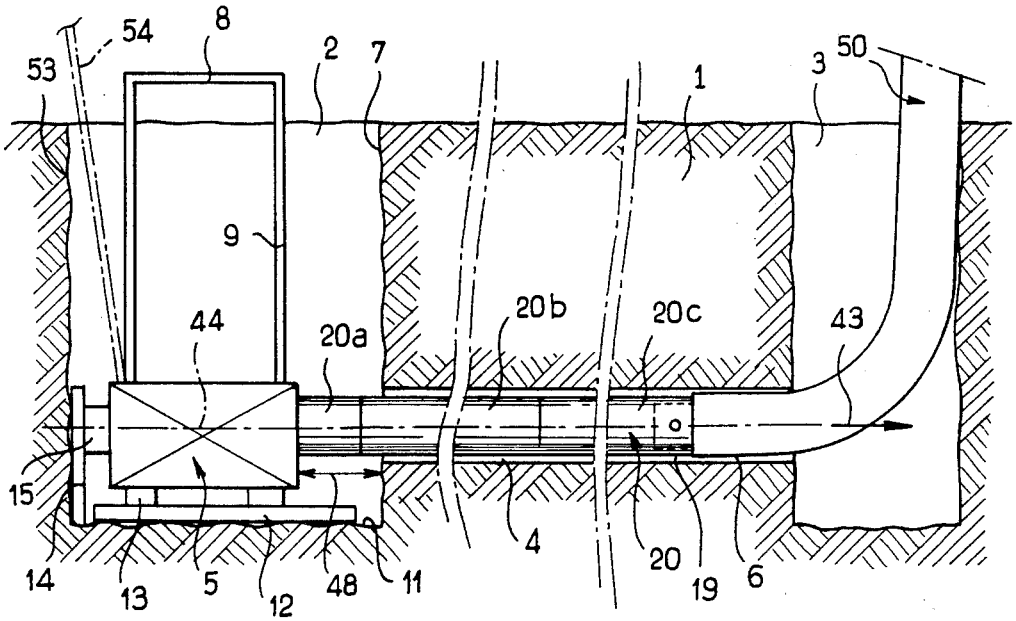

In case the drilled hole should not be provided with such a metal lining, as shown in FIG. 7, after having secured to the foremost zone 19 of the tube 20, at the site of the boring bit 16, an end of a sheath or flexible pipeline 50 or of a cable that is going to be disposed in the drilled hole 4 and having adjusted against the surface 7 of the pit 2 the fore part of the frame 29 of the device by means, for example, of two shanks of hydraulic energy known to those skilled in the art and diagrammatically shown in 48, the guide block 26 being in foremost position, there are locked together the portion 20c of the tube 20, that is, the rearmost zone thereof, and the guide block 26, for instance, by means of a pin 51 that penetrates the collar 37 and the tube 20, which for this purpose can be pierced in places (see FIG. 2).

The hydraulic cylinders 38 are then actuated in a direction opposite to direction 43 toward their retracted state in order to draw to the rear the guide block 26 and the tube 20 by means of hydraulic cylinders; from the moment the gude block 26 reaches the rearmost position, this portion 20c is wholly disengaged from the drilled hole 4, this rear portion 20c is separated from the other portions and then the guide block 26 is brought back to the foremost position by means of the hydraulic cylinders, the portion 20b is integrated with the collar 37 in the same manner as above, and the guide block 26 is brought back to its rearmost position in which the portion 20b is detached from the portion 20a; these operations are then repeated for the portion 20a, which, when the guide block 26 reaches the rearmost position, detaches itself completely from the drilled hole 4 and detaches therefrom the end of the flexible sheath 50 or of the cable that can then be detached from said portion 20a.

In this case it is evident that the coupling between the portions is of a dismountable type.

In all cases, the tube and the boring bit forming a rigid whole perfectly guided into the device that is itself adjusted and accurately positioned, it is understood that the drilling is performed with great precision, all the more so since from the beginning the whole tube engaged in the drilling also cooperates in the guiding.

The possibility of deviation of path in a distance of about ten meters remains at less than a few centimeters.

The average time for the drilling of such a ten-meter hole is on the order of two hours.

These figures are naturally given by way of non-limiting example.

In the boring bit 6 there can evidently be included a hammer the jolts of which, by reason of the guiding, would not endanger the trajectory, but the boring bit preferably will not have such a hammer and will therefore advance regularly under the pressure of the hydraulic cylinders.

Within the limits of the possibilities of adjustments, this device can evidently be used not only for horizontal drillings but also for inclined and even vertical ones, the same as for blind holes.

I claim:

1. A device for drilling the soil including a carrying frame (29), a tool (6), displacement means for translation of said tool (6) in relation to said frame (29) in a given drilling direction (43) and means (13, 15) to support said frame (29) on the soil (1) at least toward the rear with reference to said drilling direction (43), characterized in that said displacement means for translation of said tool (6) in relation to said frame (29) in said frame (29) in said drilling direction (43) include:

(a) means forming a slide (27, 28) that is integral with said frame (29) and oriented parallel with said drilling direction (43), (b) a guide block (26) carried by said slide-forming means (27, 28), and guided for translation therealong parallel with said drilling direction (43) in relation to said frame (29), said guide block (26) defining a housing (46) at least partly closed toward the rear and laterally and open toward the front in reference to said drilling direction (43), (c) pressure means (37,38) acting between said frame (29) and said guide block (46) in the direction of translation of the latter along said slide-forming means (27,28) in relation to said frame, at least in said drilling direction (43), (d) tube-forming means (20) having a rectilinear axis (44), the tube-forming means (20) being fitted in said housing (46) and in abutment in the interior of said housing, in relation to said guide block (26), toward the rear and laterally in reference to said drillng direction (43), into a position in which said axis (44) of said tube-forming means (20) is parallel with said drilling direction (43), but is free for translation within said housing (46) in opposite direction in relation to said drilling direction, and the dimension (L) of said tube (20) parallel with the axis thereof being larger than the dimension (1) of said housing (46) parallel with said drilling direction (43) so that said tube-forming means (20) has an end zone (19) projecting forwardly in reference to said drilling direction (43), outside said housing (46) of said guide block (26), and in that said tool (6) comprises (e) a boring bit (6) integrally carried by said end zone (19) of said tube (20) and externally having, successively from the front to the rear in reference to said drilling direction (43), a flat cutting edge across said axis (44) of said tube-forming means (20, a frustoconical cutting edge (16) revolving about said axis (44) and converging to the front in reference to said drilling direction (43), a cylindrical cutting edge (17) revolving about said axis (44) of said tube (20) and joining said frustoconical cutting edge, said cylindrical cutting edge (17) having a diameter (D) larger than the dimensions (d) that said tube (2) externally has in relation to its axis (44) and a dimension ($\lambda$) measured parallel with said axis that is smaller than that of said corresponding dimension (L) of said tube-forming means (20), (f) a stem integral with said boring bit (6) immediately behind said cylindrical cutting edge (17) of the latter in reference to said drilling direction (43), said stem (18) being inserted in said end zone (19) of said tube-forming means (29), detachable locking means (21) ensuring the integration of said stem (18) with said tube-forming means (20), (g) said guide block (26) has in reference to said drilling direction (43) a front end zone where it integrally carries a collar (32) that laterally closes said housing (46) in reference to said drilling direction (43) by surrounding said drilling direction in order to avoid any displacement of the tube (40) along a direction transverse to the drilling direction (43), said collar (32) conforming in shape with said tube (40) and immobilizing it transversely in relation to said drilling direction (43) in an intermediate zone (47) of said tube (40).

2. A drilling device according to claim 1, characterized in that said collar (32) comprises two sectors (34, 33), which are a sector (35) permanently integral with said guide block (26) and a sector (34) detachably integral with said guide block (26), and detachable means for locking together said two sectors to close said collar (32) around a tube (20) or open said collar (32) and make free the access for a tube (20) between the interior and exterior of said collar, transversely in relation to said drilling direction (43).

3. A drilling device according to claim 1, characterized in that said pressure means (37, 38) include two screw-jacks situated behind said collar (37) respectively at each side of said guide block (26) parallel with said drilling direction (43) and acting upon said guide block (26) in the immediate proximity of said collar.

4. A drilling device according to claim 1, characterized in that said means (13, 15) that support said frame (29) on the soil include screw-jacks (13, 15) that regulate said drilling direction (43).

5. A drilling device according to claim 1, characterized in that said tube-forming means (20) includes a plurality of portions (20*a*, 20*b*, 20*c*) assembled in a rigid, rectilinar whole.

6. A drilling device according to claim 1, characterized in that said pressure means (37, 38) include screw-jacks (38) of double action.

7. A device for drilling the soil including a carrying frame (29), a tool (6), displacement means for translation of said tool (6) in relation to said frame (29) in a given drilling direction (43) and means (13, 15) to support said frame (29) on the soil (1) at least toward the rear with reference to said drilling direction (43), characterized in that said displacement means for translation of said tool (6) in relation to said frame (29) in said drilling direction (43) includes:

(a) means forming a slide (27,28) that is integral with said frame (29) and oriented parallel with said drilling direction (43), (b) a guide block (26) carried by said slide-forming means (27,28) and guided for translation therealong parallel with said drilling direction (43) in relation to said frame (29), said guide block (26) defining a housing (46) at least partly closed toward the rear and laterally and open toward the front in reference to said drilling direction (43), (c) pressure means (37,38) acting between said frame (29) and said guide block (46) in the direction of translation of the latter along said slide-forming means (27,28) in relation to said frame, at least in said drilling direction (43), (d) tube-forming means (20) having a rectilinear axis (44), the tube-forming means (20) being fitted in said housing (46) and in abutment in the interior of said housing, in relation to said guide block (26), toward the rear and laterally in reference to said drilling direction (43), into a position in which said axis (44) of said tube-forming means (20) is parallel with said drilling direction (43), but is free for translation within said housing (46) in opposite direction in relation to said drilling direction, and the dimension (L) of said tube (20) parallel with the axis thereof being larger than the dimension (L) of said housing (46) parallel with said drilling direction (43) so that said tube-forming means (20) has an end zone (19) projecting forwardly in reference to said drilling direction (43), outside said housing (46) of said guide block (26), and in that said tool (6) comprises (e) a boring bit (6) integrally carried by said end zone (19) of said tube (20) and externally having, successively from the front to the rear in reference to said drilling direction (43), a flat cutting edge across said axis (44) of said tube-forming means (20), a frustoconical cutting edge (16) revolving about said axis (44) and converging to the front in reference to said drilling direction (43), a cylindrical cutting edge (17) revolving about said axis (44) of said tube (20) and joining said frustoconical cutting edge, said cylindrical cutting edge (17) having a diameter (D) larger than the dimensions (d) that said tube (2) externally has in relation to its axis (44) and a dimension ($\lambda$) measured parallel with said axis (44) that is smaller than that of said corresponding dimension (L) of said tube-forming means (20), (f) a stem integral with said boring bit (6) immediately behind said cylindrical cutting edge (17) of the latter in reference to said drilling direction (43), said stem (18) being inserted in said end zone (19) of said tube-forming means (20), detachable locking means (21) ensuring the integration of said stem (18) with said tube-forming means (20), (g) said guide block (26) has in reference to said drilling direction (43) a rear end zone where it integrally carries a plate (30) that closes said housing (46) toward the rear in reference to said drilling direction (43) so as to constitute a stop for an end (25) of said tube (20) opposite to said end zone (19) of the latter, and integrally carrying, inside said housing (46) and toward the front in reference to said drilling direction (43), a ring (31) that conforms in shape with said opposite end (25) of said tube (20) and immobilizes it transversely in relation to said drilling direction (43) and in that said guide block (26) has in reference to said drilling direction (43) a front end zone where it integrally carries a collar (32) that laterally closes said housing (46) in reference to said drilling direction (43) by surrounding said drilling direction in order to avoid any displacement of the tube (40) along a direction transverse to the drilling direction (43), said collar (32) conforming in shape with said tube (40) and immobilizing it transversely in relation to said drilling direction (43) in an intermediate zone (47) of said tube (40).

* * * * *